US006381997B1

(12) United States Patent
Chen

(10) Patent No.: US 6,381,997 B1
(45) Date of Patent: May 7, 2002

(54) COMBINATION PADLOCK

(76) Inventor: Cheng Jung Chen, No. 47, Lane 66, Hai-Ming St., Hai-Pu Li, Lu-Kang Township, Chang Hua Hsien (TW)

( * ) Notice: Subject to any disclaimer, the term of this patent is extended or adjusted under 35 U.S.C. 154(b) by 0 days.

(21) Appl. No.: 09/838,066

(22) Filed: Apr. 20, 2001

(51) Int. Cl.[7] ..... E05B 37/02
(52) U.S. Cl. ..... 70/28; 70/312
(58) Field of Search ..... 70/22, 23, 27–29, 70/312

(56) References Cited

U.S. PATENT DOCUMENTS 1,117,417 A * 11/1914 Meepos ..... 70/29
4,803,856 A * 2/1989 Ling ..... 70/28
4,860,561 A * 8/1989 Hwang ..... 70/28
5,042,277 A * 8/1991 Jenn-Rong ..... 70/28
5,609,048 A * 3/1997 Ling ..... 70/28
5,685,179 A * 11/1997 Yang ..... 70/28
5,765,409 A * 6/1998 Yang ..... 70/28
5,782,113 A * 7/1998 Chen ..... 70/28
5,901,587 A * 5/1999 Chen ..... 70/28
5,918,489 A * 7/1999 Yang ..... 70/28
5,970,755 A * 10/1999 Appelbaum ..... 70/28
6,082,155 A * 7/2000 Su ..... 70/28 X

* cited by examiner

*Primary Examiner*—Lloyd A. Gall
(74) *Attorney, Agent, or Firm*—Harrison & Egbert

(57) ABSTRACT

A combination padlock includes a main body, a shackle, a control mechanism, an unlocking key, and a rotary block. The rotary block is located between the unlocking key and the free end of the shackle. As the unlocking key is pushed by a finger, the unlocking key actuates the rotary block to turn in such a manner that one end of the rotary block moves away from the free end of the shackle, and that the other end of the rotary block exerts a pressure on a stop plate of an actuation rod of the control mechanism, thereby resulting in the downward displacement of the actuation rod.

2 Claims, 6 Drawing Sheets

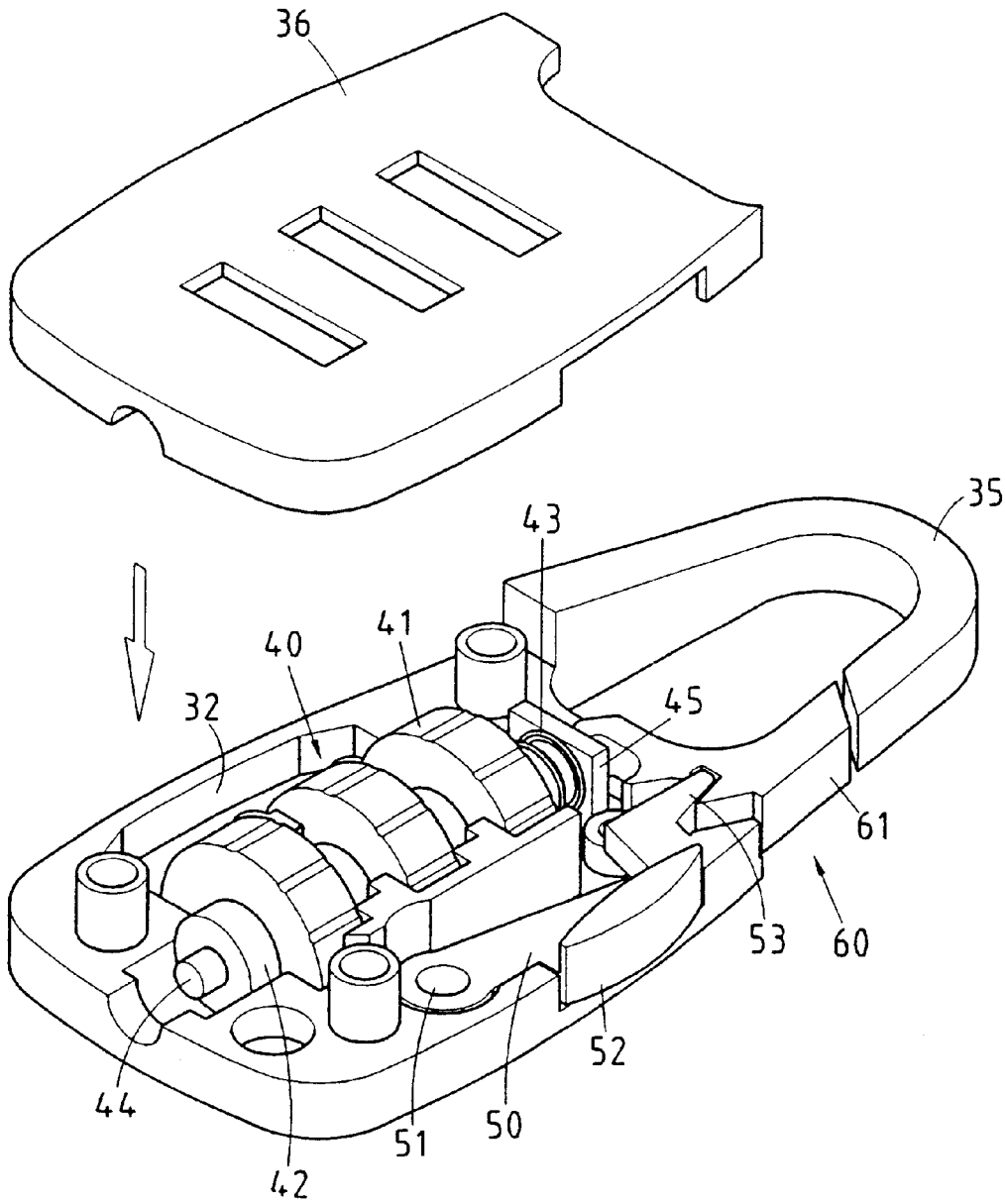
FIG. 3-A

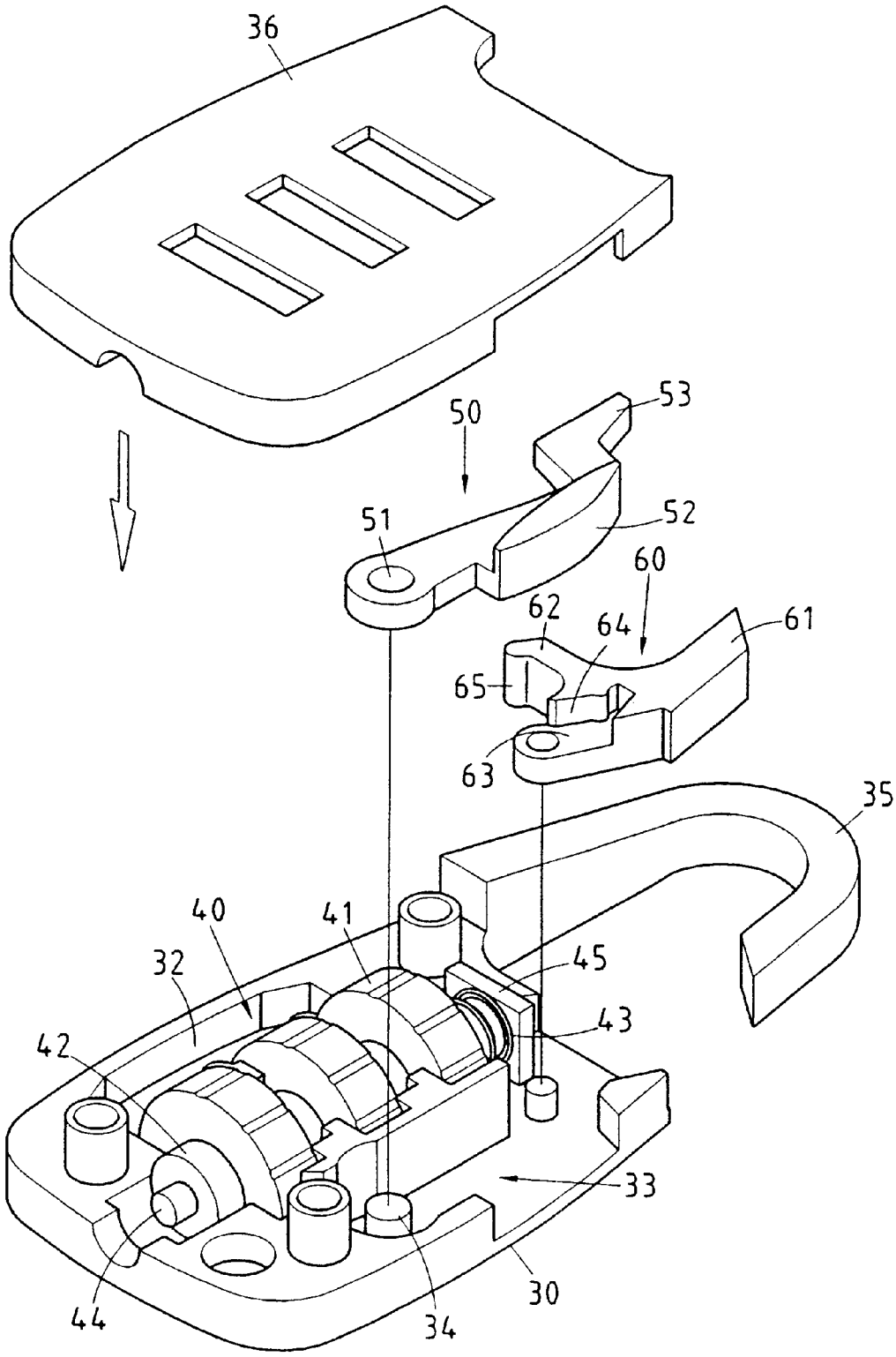
FIG. 3-B

COMBINATION PADLOCK

BACKGROUND OF THE INVENTION

1. Field of the Invention

The present invention relates generally to a padlock, and more particularly to a combination padlock.

2. Description of Related Art

As shown in FIG. 1, a prior art combination padlock comprises a main body 10, an actuation set 11, an unlocking key 12, and a shackle 21. The actuation set 11 is formed of a plurality of dial wheels 13, an actuation block 14, a recovery spring 15, and an actuated rod 16. The actuation rod 16 is provided at the top end with a stop plate 17 having a recessed portion 18. The unlocking key 12 has a press arm 19 and a lock arm 20. When the prior art combination padlock is in the locking state, the free end of the press arm 19 of the unlocking key 12 is stopped in the recessed portion 18 of the stop plate 17. In the meantime, the lock arm 20 of the unlocking key 12 is joined with the free end of the shackle 21. In the process of unlocking the prior art combination padlock, the dial wheels 13 are turned to a correct set series of numbers, thereby enabling the lock arm 20 of the unlocking key 12 to be pushed inward with a finger. As a result, there is a space between the lock arm 20 and the free end of the shackle 21. In the meantime, the actuation rod 16 is forced to displace downward by the press arm 19 of the unlocking key 12.

The prior art combination padlock has shortcomings. In the first place, the finger exerting on the lock arm 20 of the unlocking key 12 becomes an obstruction. In addition, the free end of the press arm 19 of the unlocking key 12 and the stop plate 17 of the top end of the actuation rod 16 are susceptible to wear because of mechanical friction.

BRIEF SUMMARY OF THE INVENTION

The primary objective of the present invention is to provide a combination padlock which is free of the deficiencies of the prior art combination padlock described above.

The combination padlock of the present invention comprises a main body, a control set, an unlocking key, and a shackle. The present invention is characterized by the unlocking key which is provided with a rotary block located between the unlocking key and the shackle. As the unlocking key is exerted on by an external force, the rotary block moves away from the free end of the shackle, thereby resulting in an open space between the rotary block and the shackle. The control set comprises an actuation rod which is provided at the top end with a flat stop portion. As the rotary block moves away from the shackle, a press portion of the rotary block exerts pressure on the flat stop portion of the actuation rod, thereby resulting in downward displacement of the actuation rod.

The features, functions and advantages of the present invention will be more readily understood upon a thoughtful deliberation of the following detailed description of a preferred embodiment of the present invention in reference to the accompanying drawings.

BRIEF DESCRIPTION OF THE SEVERAL VIEWS OF THE DRAWINGS

FIG. 3A shows a partial exploded view of the combination padlock of the preferred embodiment of the present invention.

FIG. 3B shows an exploded view of the main body, the unlocking key, and the rotary block of the combination padlock of the preferred embodiment of the present invention as shown in FIG. 3A.

DETAILED DESCRIPTION OF THE INVENTION

Figure 1:
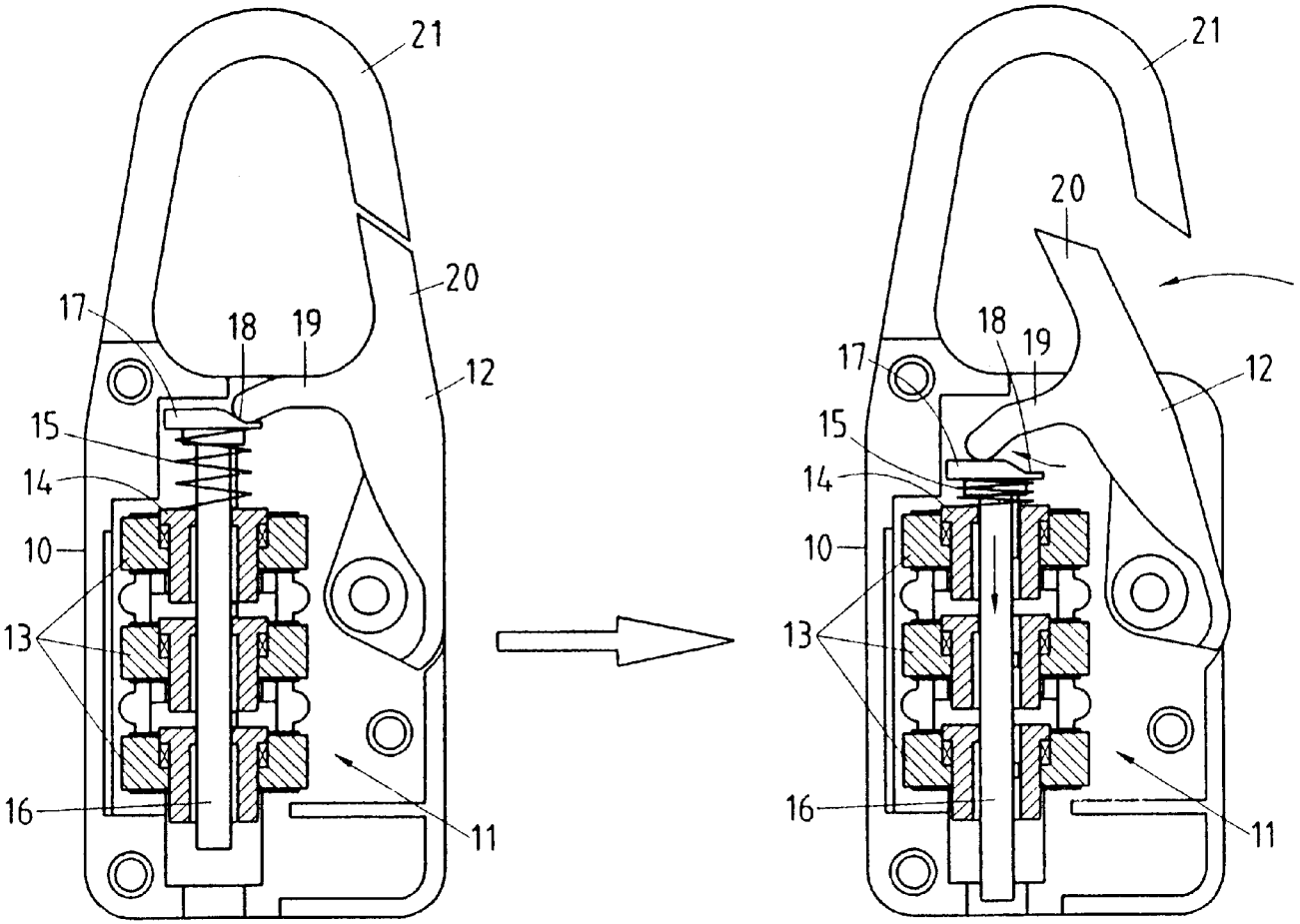
FIG. 1 PRIOR ART
FIG. 1 is a sectional view of a combination padlock of prior art at work.
Figure 2:
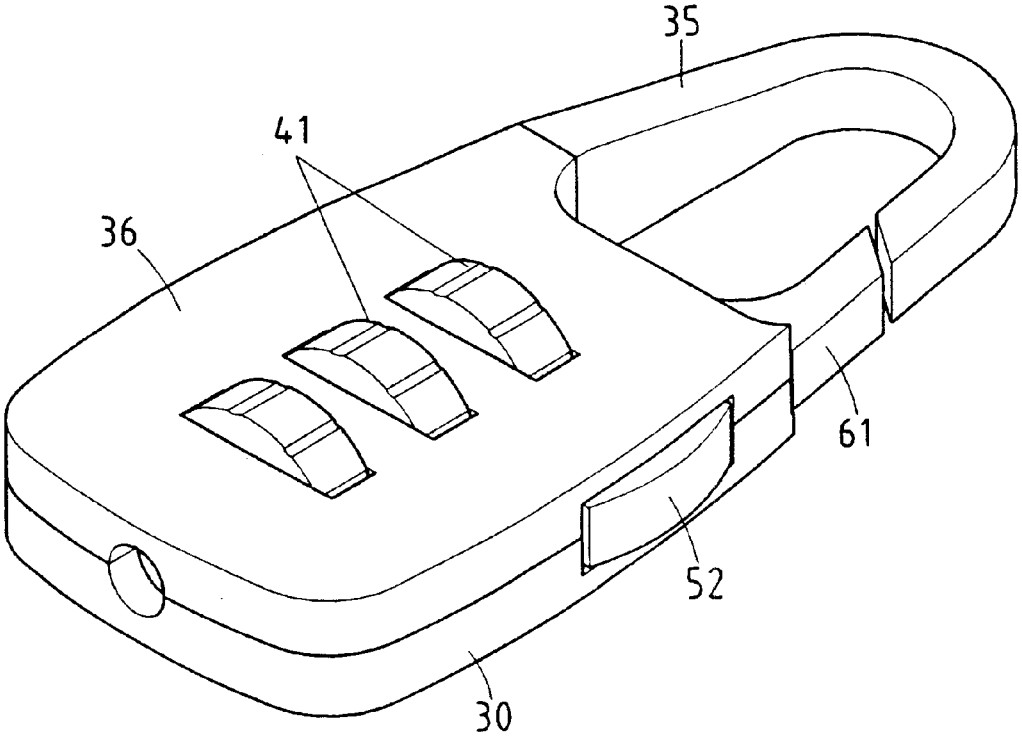
FIG. 2 shows a perspective view of a combination padlock of the preferred embodiment of the present invention.
Figure 4:
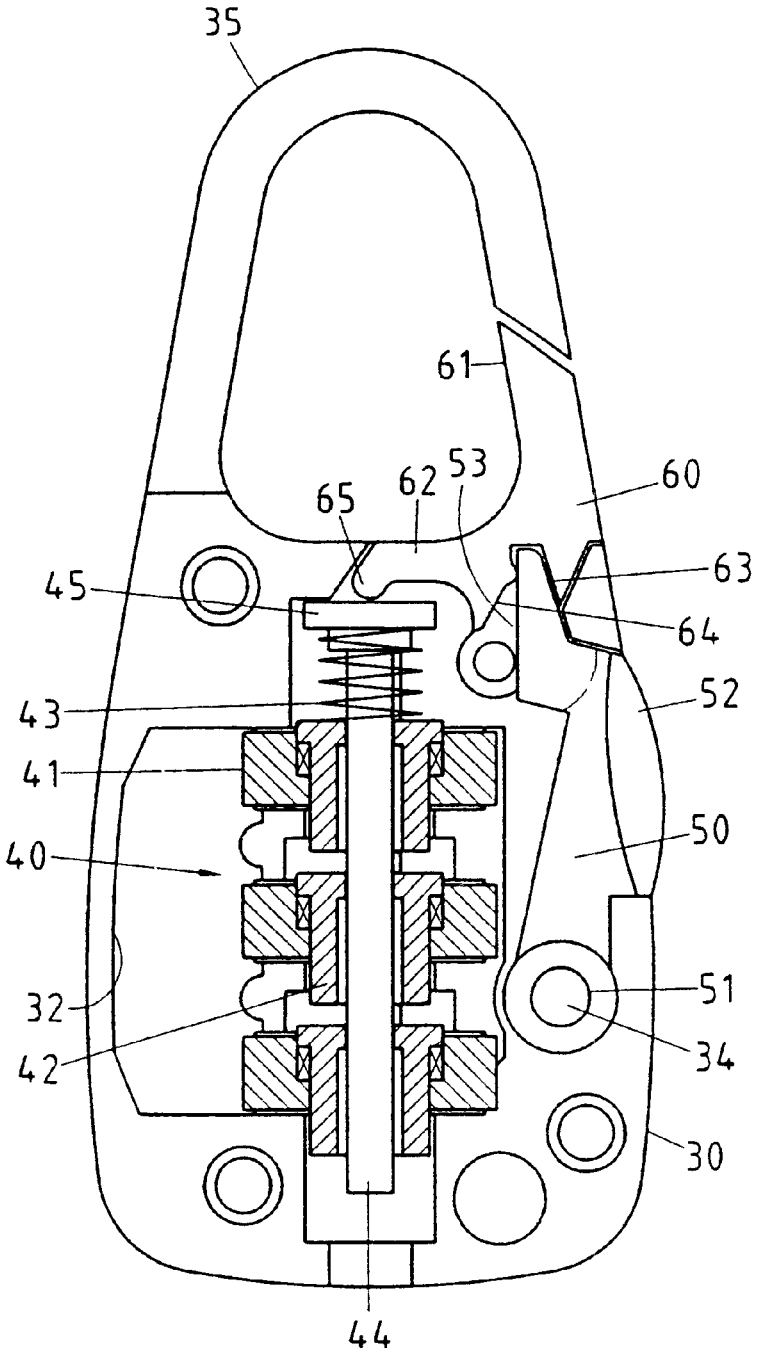
FIG. 4 shows a longitudinal sectional view of the combination padlock of the preferred embodiment of the present invention.

As shown in FIGS. 2–5, a combination padlock embodied in the present invention comprises a main body 30 which is provided in the interior with a first receiving slot 32 and a second receiving slot 33 which is in turn provided in the bottom wall with a pillar 34 extending upward. The main body 30 is further provided with a shackle 35 extending from one end thereof. The first receiving slot 32 is intended to dispose therein a control set 40 which is formed of a plurality of dial wheels 41, an actuation block 42, a recovery spring 43, and an actuation rod 44. The actuation rod 44 is provided at an upper end with a stop plate 45. The upper end of the actuation rod 44 refers to the end that faces the shackle 35. A cover 36 is joined with the main body 30 such that the first receiving slot 32 and the second receiving slot 33 are covered by the cover 36, and such that the dial wheels 41 of the control set 40 partially juts out of through slots of the cover 36.

An unlocking key 50 is disposed in the second receiving slot 33 of the main body 30 and is provided at one end with a rotation hole 51, and in the outer side of the midsegment thereof with a push portion 52. The unlocking key 50 is disposed in the second receiving slot 33 in such a manner that the pillar 34 of the second receiving slot 33 is fitted into the rotation hole 51 of the unlocking key 50, and that the push portion 52 of the unlocking key 50 is jutted out of the main body 30 and the cover 36.

Figure 5:
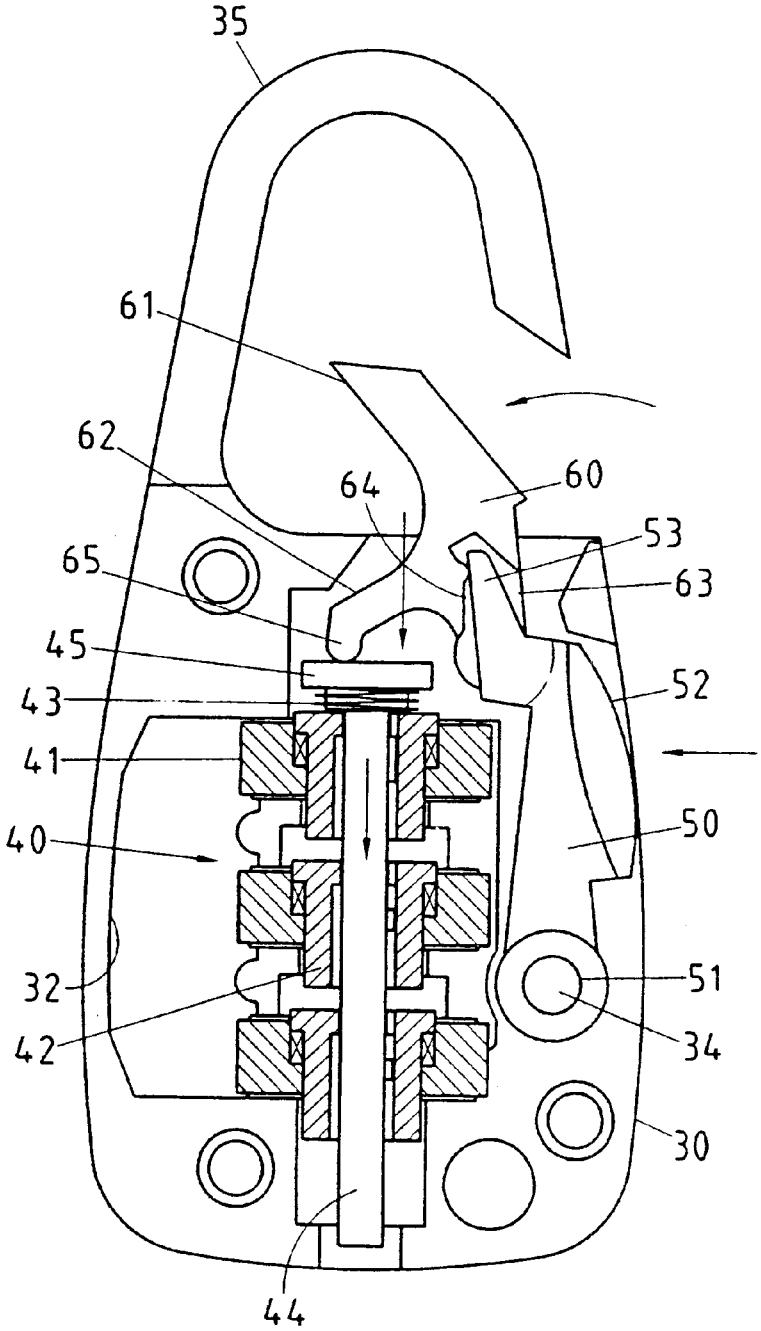
FIG. 5 shows a longitudinal sectional view of the combination padlock of the preferred embodiment of the present invention at work.

The unlocking key 50 is provided with a rotation end 53 opposite in location to the rotation hole 51, and a rotary block 60 located between the rotation end 53 of the unlocking key 50 and a free end of the shackle 35. The rotary block 60 is provided at one end with a lock portion 61 opposite to the free end of the shackle 35 at the time when the combination padlock of the present invention remains in the locking state. The rotary block 60 is provided at other end with a press portion 62 and a slot 63 corresponding in location to the rotation end 53 of the unlocking key 50. The slot 63 is provided with a push edge 64. When the push portion 52 of the unlocking key 50 is pushed by a finger, the rotation end 53 of the unlocking key 50 pushes the push edge 64 so as to acuate the rotary block 60 to turn, thereby causing the lock portion 61 of the rotary block 60 to move away from the free end of the shackle 35. In the meantime, the press portion 62 of the rotary block 60 presses the stop plate 45 of the actuation rod 44, thereby resulting in the downward displacement of the actuation rod 44, as illustrated in FIG. 5.

The press portion 62 of the rotary block 60 is provided with a protruded edge 65, which comes in contact with the stop plate 45 of the actuation rod 44. As the combination padlock of the present invention is in the process of shifting from the locking state to the unlocking state, the rotary block 60 is actuated by the unlocking key 50 to turn such that the protruded edge 65 of the press portion 62 of the rotary block 60 slides on the stop plate 45 of the actuation rod 44, thereby resulting in reduction in mechanical friction between the press portion 62 and the stop plate 45.

It must be noted here that the push portion 52 of the unlocking key 50 is located in such a manner that a finger pushing the push portion 52 does not become an obstruction at such time when the combination padlock of the present invention is being used to fasten something securely.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. A combination padlock comprising:

a main body comprised of a first receiving slot, a second receiving slot provided in a bottom wall with a pillar, and a shackle extending from one end thereof;

a cover joined with said main body such that said first receiving slot and said second receiving slot are covered by said cover, said cover provided with a plurality of through slots;

a control set comprised of a plurality of dial wheels, an actuation block, a recovery spring, and an actuation rod which is provided at an upper end with a stop plate, said control set being disposed in said first receiving slot of said main body such that said dial wheels of said control set partially jut out of said main body via said through slots of said cover;

an unlocking key provided at one end with a rotation hole, and in an outer side of a midsegment thereof with a push portion, said unlocking key being disposed in said second receiving slot of said main body in such a manner that said pillar of said second receiving slot is fitted into said rotation hole of said unlocking key, and that said push portion of said unlocking key juts out of said main body and said cover to facilitate the pushing of said push portion by a finger, said unlocking key being further provided with a rotation end opposite in location to said rotation hole; and a rotary block located between said rotation end of said unlocking key and a free end of said shackle, said rotary block provided at one end with a lock portion opposite to the free end of said shackle at such time when said combination padlock is in the locking state, said rotary block further provided at an opposite end with a press portion and a slot corresponding in location to said rotation end of said unlocking key, said slot being provided with a push edge which is pushed by said rotation end of said unlocking key at such time when said push portion of said unlocking key is pushed by the finger, thereby actuating said rotary block to turn so as to cause said lock portion of said rotary block to move away from the free end of said shackle whereby said press portion of said rotary block presses said stop plate of said actuation rod, thereby resulting in a downward displacement of said actuation rod.

2. The combination padlock as defined in claim 1, wherein said press portion of said rotary block is comprised of a protruded edge which is in contact with said stop plate of said actuation rod at the time when said combination padlock remains in the locking state whereby said protruded edge of said press portion of said rotary block is caused to slide on said stop plate of said actuation rod to result in the downward displacement of said actuation rod at such time when said rotary block is actuated to turn by said unlocking key.

* * * * *